US005649341A

United States Patent [19]

Ashline et al.

[11] Patent Number: 5,649,341

[45] Date of Patent: Jul. 22, 1997

[54] CINCH LATCH PLATE AND BUCKLE

[75] Inventors: Trevor Ashline, Waterford; Jon E. Burrow, Sterling Heights; James W. Burrum, Clarkston; Alice Dunmire, Rochester Hills; William Fox; David Prentkowski, both of Warren, all of Mich.

[73] Assignee: AlliedSignal Inc., Morristown, N.J.

[21] Appl. No.: 638,662

[22] Filed: Apr. 29, 1996

[51] Int. Cl.[6] ..... A44B 11/10; A44B 11/25

[52] U.S. Cl. ..... 24/171; 24/196; 24/640

[58] Field of Search ..... 24/171, 194, 196, 24/640, 641, 642, 170

[56] References Cited

U.S. PATENT DOCUMENTS

| | | | |
|---|---|---|---|
| 3,408,707 | 11/1968 | Hemphill | 24/196 |
| 4,167,054 | 9/1979 | Yamada et al. | 24/171 |
| 4,294,467 | 10/1981 | Frantom | 24/171 X |
| 4,473,926 | 10/1984 | Ono | 24/194 X |

FOREIGN PATENT DOCUMENTS

| | | | |
|---|---|---|---|
| 1072643 | 9/1954 | France | 24/196 |
| 2046077 | 3/1972 | Germany | 24/196 |
| 2320314 | 10/1974 | Germany | 24/196 |
| 3216075 | 11/1983 | Germany | 24/196 |

*Primary Examiner*—Peter M. Cuomo
*Assistant Examiner*—Hanh Tran

[57] ABSTRACT

A manually activated seat belt device comprising: a latch plate (20) and cooperating buckle (100). The latch plate comprises: a tongue (22) lockingly engaging a cooperating part of a seat belt buckle (100) and a second part (26) having a seat belt clamping surface (30) adjacent a belt receiving opening (28) within the second part, walls (32) extending about opposite sides of the opening (28), a yoke (40) slidably received upon the latch plate (20) above the opening and slidably positioned against the walls of the second part, a clamping bar (48), wherein the seat belt (90) is inserted through the first opening (28) between the belt clamping surface and the clamping bar; a clamp initiating mechanism (60) manually movable from a cinching position to a clamping or locking position, including a cam surface (63) which when moved to the cinching position urges the clamping bar toward the clamping surface to thereby clamp the seat belt therebetween, wherein the buckle includes a recess to receive a locking tab to maintain the mechanism (60) in its locking position and for releasing same.

11 Claims, 2 Drawing Sheets

CINCH LATCH PLATE AND BUCKLE

BACKGROUND AND SUMMARY OF THE INVENTION

The present application generally relates to buckles and latch plates for seat belts and more specifically to a locking latch plate and cooperating buckle.

More specifically the present invention relates to a manually activated cam mechanism which locks the lap belt portion of the seat belt (also sometimes referred to as "web or webbing") preventing it from tightening about the occupant. The cam mechanism is automatically released when the release button of the buckle is depressed.

The present invention will be described in the context of a three-point restraint system, however, this is not a limitation of the present invention. A typical three-point seat belt system includes a retractor, fastened to the vehicle frame or seat, a web guide (web support, D-ring) mounted to the B-pillar (or to the seat), a latch plate, having a tongue portion for insertion into a buckle. The latch plate is often slidable on the shoulder belt portion of the seat belt. The buckle can be mounted to the vehicle floor or to the seat. Upon inserting the tongue into the buckle the seat belt is divided into a shoulder belt portion and a lap belt portion to protect the occupant. As is known in the art, seat belt retractors include a rewind spring which provides a bias force to rewind excess slack in the seat belt upon a spool of the retractor. As the vehicle hits large holes and bumps in the road, it and the occupant begin to bounce. When the occupant bounces onto the seat a transient amount of slack in the seat belt is created as the seat is compressed (by the occupant). This response is more predominant in certain off-the-road vehicles which encounter very rough roadways. The rewind bias spring of the retractor eliminates this slack and attempts to pull the seat belt taut (to cinch) about the upper torso and lap of the occupant. However, when the occupant rebounds off the seat or when the vehicle stops bouncing the occupant may find that the lap belt has slid through the latch plate and is now uncomfortably tightened about his or her body necessitating the removal of the latch plate from the buckle to re-fit the seat belt about his/her body.

Accordingly, the present invention comprises: a manually activated seat belt device comprising: a latch plate comprising: a tongue including first locking means for lockingly engaging a cooperating part of a seat belt buckle. The latch plate additionally includes a rear or second part, having a seat belt web clamping surface adjacent to a belt receiving opening. The rear part includes walls extending about opposite sides of the belt receiving opening and a yoke which is slidably received upon the latch plate above the opening and slidable relative to the walls of the second or rear part. The yoke also includes a clamping bar. The seat belt is inserted through the belt receiving opening between the belt clamping surface and the clamping bar. The latch plate also includes a clamp or lock initiating mechanism manually movable from a cinching or free position to a locking position and includes a cam surface which when moved to its locking or cinching position urges the rear bar toward the clamping surface to thereby clamp or lock the seat belt therebetween and first means cooperable with a seat belt buckle to maintain the mechanism in its locking position and for releasing same when the button of the seat belt buckle is depressed.

It is an object of the present invention to provide a latch plate that can be manually locked upon the seat belt to prevent the seat belt from being excessively tightened about an occupant. A further object of the present invention is to provide a seat belt buckle with a release button to deactivate the locked seat belt.

Many other objects and purposes of the invention will be clear from the following detailed description of the drawings.

DETAILED DESCRIPTION OF THE DRAWINGS

Figure 1:
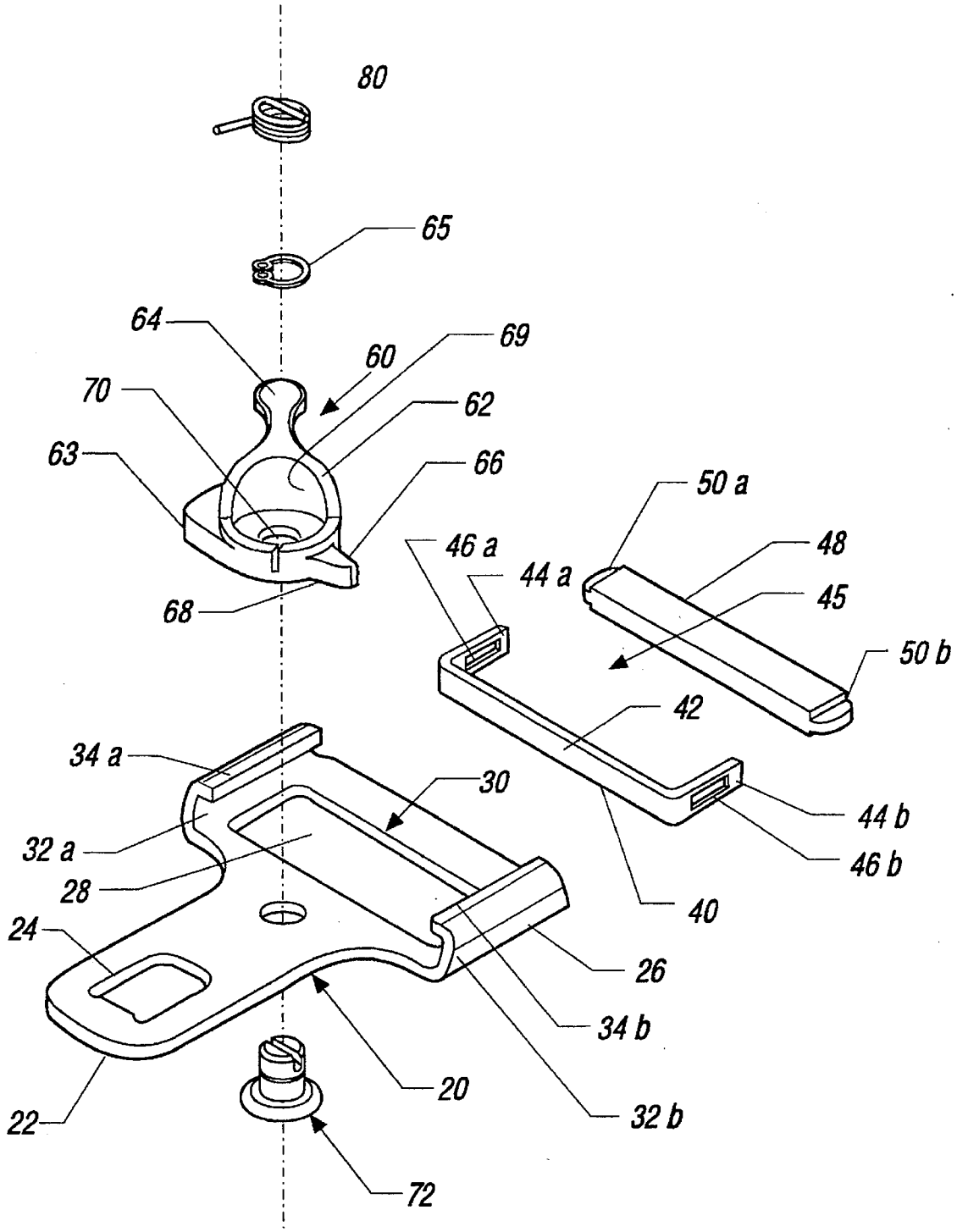
FIG. 1 is an exploded view of the major portions of a latch plate.
Figure 4:
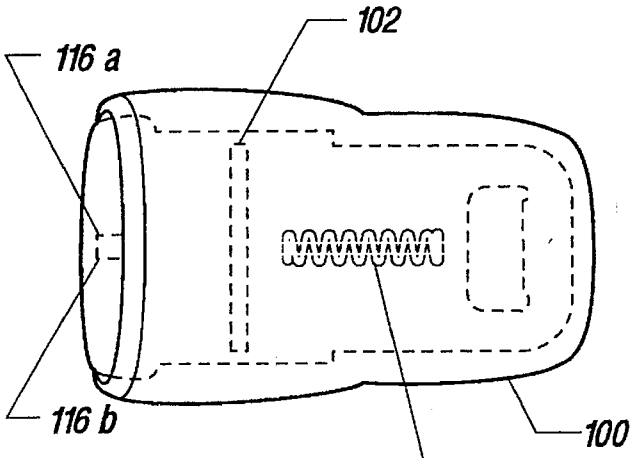
FIG. 4 is a top view of a buckle.
Figure 5:
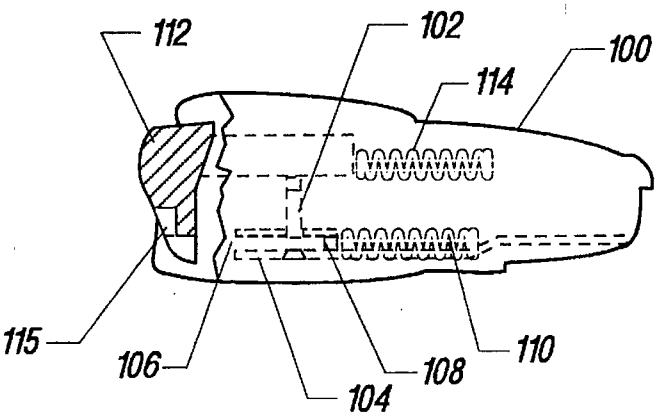
FIG. 5 is a cross-sectional view of a buckle.
Figure 2:
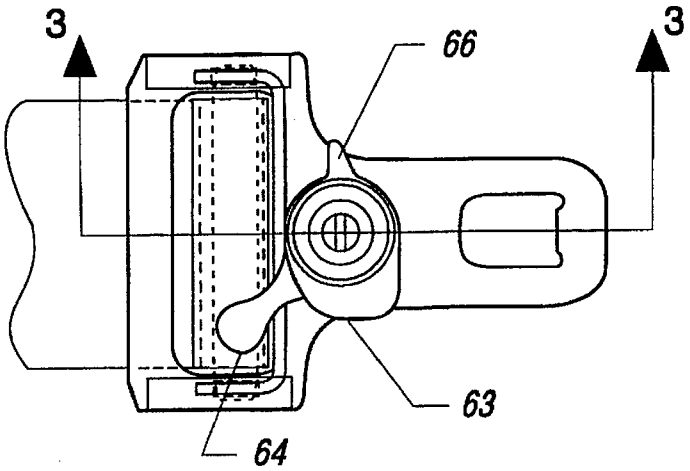
FIG. 2 is a plan view of a latch plate.
Figure 3:
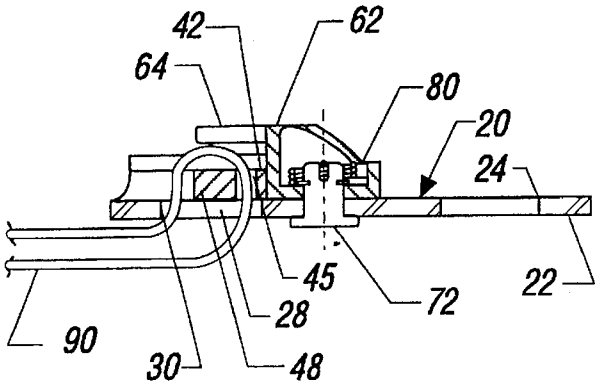
FIG. 3 is a cross-sectional view through section lines 3—3 of FIG. 2.

Reference is made to FIGS. 1–3 which illustrate a clamping, slip tongue or latch plate 20 used in conjunction with the buckle 100 shown in FIGS. 4 and 5. The latch plate 20 includes a forward portion or tongue 22 having an opening 24 therein. This opening provides a first means for cooperatively locking with a locking mechanism or latch generally shown as 102 of buckle 100 in the other figures. Positioned adjacent the tongue 22 is a second or rear part 26 having a belt receiving opening 28 therein. The opening 28 is defined by a plurality of walls integrally formed in this second part. One of these walls 30 defines a seat belt clamping surface. The rear part 26 includes a plurality of arcuately shaped walls 32*a* and 32*b* which slidingly receive a yoke 40 which clamps or locks the seat belt in place. The tops 34*a* and 34*b* of the walls are curved inwardly enveloping corresponding sides of the yoke. The yoke 40 includes a forward bar 42 having two connecting members or sides 44*a* and *b*. Each side includes a rectangular opening 46*a,b*. A second, clamping or rear bar 48, having at each of its ends a respective tab 50*a*,50*b*, is received within a corresponding one of the openings 46*a*,46*b* in the forward bar 42. As will be seen from the description below the yoke and in particular the rear bar 48 moves across the opening 28 relative to the clamping surface 30 to selectively clamp the seat belt against the clamping surface.

Rotatably positioned on the latch plate 20 is a clamp initiating mechanism 60. This mechanism 60 is manually movable from a first position permitting the webbing to slide through the latch plate and be cinched about the occupant (first cinching position) to a second or locking position. In this second position the mechanism 60 moves the yoke 40 into a clamping (i.e. locking) engagement with the seat belt. More specifically, the mechanism includes a body 62 having a manually operable lever 64 and a cam surface 63 which when rotated clockwise engages the forward bar 42 urging the yoke rearward, cinching or capturing the webbing 90 between the rear bar 48 and the clamping surface 30. The mechanism also includes a narrow locking tab 66 having a cam surface 68 which also extends from the body 62. The body 62 additionally includes a cavity 69 with a center opening 70 to receive a stud 72. Stud 72 acts as an axle about which the body 62 rotates as well as a spring arbor to receive one end of a rewind spring 80, the other end of which is connected to the body 62 to provide for a reverse bias to the mechanism 60. The body 62 is maintained in place by a retaining clip 65. A retention cap, not shown, is used to enclose the cavity and retain the spring 80. FIGS. 2 and 3 show a seat belt or webbing 90 wrapped about the rear bar 48. As can be seen the seat belt 90 enters the opening 28, is threaded about the rear bar 48 and then exits through the opening 28.

Reference is briefly made to FIGS. 4 and 5 which illustrate a typical seat belt buckle 100 modified in accordance with the present invention. The button 112 includes a locking mechanism 102, of known design, which in the embodiment shown moves vertically upward and downward from a release position to a locking position in engagement with the opening 24. The buckle includes a frame 104 defining an entry channel 106 for receipt of the tongue 22 of the latch plate 20. During insertion of the tongue or first part 22 into the guide or channel 106 it engages an ejector 108 and compresses an ejection spring 110. In this position the latch or locking member 102 has already entered the lock opening 24 to hold the latch plate in place. The latch plate 20 is released by pressing the button 112 inwardly against the bias of the spring 114. While not shown, typical buttons include ramped surfaces which lift the locking member 102 out of the opening 24 as the release button is pushed permitting the spring 110 to eject the latch plate 20.

In the preferred embodiment of the invention the button 112 includes a recess 115 having walls 116*a*, 116*b*. When the occupant desires to lock the seat belt in place, that is to prevent the lap portion from sliding through the latch plate, he manually rotates the lever 64 clockwise (when viewed in FIG. 2) thereby urging the locking tab cam surface 66 against the button 112. This rotation slightly pushes the button inwardly permitting the tab 66 to enter the opening 115. The spring biased buckle 100 assists in holding the locking tab 66 in place within the recess 115.

When the occupant desires to release the seat belt from its locked position he depresses the release button thereby releasing the latch plate 20 from the buckle 100. When the button is depressed the ends of the opening 115 are moved away from the locking tab 66 thereby permitting the mechanism 60 to rotate in a counterclockwise direction, under the influence of spring 80 thereby eliminating the locking pressure on the seat belt. Thereafter, the occupant reinserts the latch plate into the buckle when refitting the belt about his body.

Many changes and modifications in the above described embodiment of the invention can, of course, be carried out without departing from the scope thereof. Accordingly, that scope is intended to be limited only by the scope of the appended claims.

We claim:

1. A seat belt device comprising:

a buckle;

a latch plate (20) comprising:

a first part or tongue (26) for lockingly engaging a cooperating part of the seat belt buckle (100);

a rear or second part (26) including a seat belt clamping surface (30) adjacent a seat belt receiving opening (28) within the second part;

a yoke (40) slidably received upon the latch plate (20) and movable relative to the belt receiving opening, including a clamping bar (48), wherein a portion of a seat belt (90) lays through the belt receiving opening (28) between the belt clamping surface and the clamping bar;

a clamp initiating mechanism (60) manually movable from a first position in which the seat belt is free to slide through the opening to a locking position in which the seat belt is locked, including a cam surface (63) which when moved to the locking position urges the clamping bar toward the clamping surface to thereby clamp the seat belt therebetween and first means cooperable with the seat belt buckle to maintain the mechanism (60) in its locking position.

2. The device as defined in claim 1 wherein the mechanism includes spring means for urging the mechanism away from its locking position toward its first position.

3. The device as defined in claim 1 wherein the clamp initiating mechanism includes a manually operable lever (64) linked to the cam surface (63), the cam surface rotatable about an axis positioned relative to the surface of the latch plate.

4. The device as defined in claim 1 wherein the yoke (40) further includes a front bar (42), the front bar and the clamping bar (48) are movable against the seat belt (90).

5. The device as defined in claim 1 wherein the buckle (100) includes a release button (112) having a recess (115) for receiving a locking tab (66) of the mechanism (60).

6. The device as defined in claim 5 wherein the buckle (100) includes a channel (106) to receive the latch plate (20) and a latch (102) to secure the latch plate therein.

7. A manually activated seat belt device comprising:

a buckle;

a latch plate (20) comprising:

a first part or tongue (22), the first part (22) including first locking means (24) for lockingly engaging a cooperating part of the seat belt buckle (100), a second part (26), rearward of the first part including a seat belt clamping surface (30) adjacent a belt receiving opening (28) within the second part, walls (32) extending about opposite sides of the opening (28), a yoke (40) slidably received on the latch plate (20) across the opening and slidably positioned against the walls of the second part, including a forward bar (42), a rear bar (48) and two connecting members (44*a,b*) connecting the forward and rear bars together, wherein a seat belt (90) lays through the first opening (28) between the belt clamping surface (30) and the rear bar (48), about the rear bar and out through the first opening;

a clamp initiating mechanism (60) manually movable from a first position to a locking or clamping position, including a cam surface (63) movable into engagement with the forward bar (42) of the yoke for urging the yoke rearward and the rear bar toward the clamping surface (30) to thereby clamp the seat belt therebetween and first means cooperable with the seat belt buckle to maintain the clamp initiating mechanism in its clamping or locking position and for releasing same and spring means for urging the mechanism to its free or first position.

8. The device as defined in claim 7 wherein the clamp initiating mechanism includes a manually operable lever (64) linked to the cam surface (63), the cam surface rotatable about an axis perpendicular to the surface of the latch plate.

9. The device as defined in claim 7 wherein the front bar (42) and connecting members (44*a,b*) of the yoke (40) are of unitary construction, and wherein each connecting member includes a respective slit (46*a,b*) to receive an end of the rear bar.

10. The device as defined in claim 7 wherein the buckle (100) includes a channel (106) to receive the latch plate (20) and a release button (112) at one end thereof adjacent the cam surface after the latch plate has been inserted into the buckle, wherein the mechanism (60) includes a locking tab (66) lockingly engageable within a recess (115) on the release button (112), the locking tab brought into engagement with the recess upon rotation of the cam surface and released therefrom upon depression of the release button.

11. A seat belt device comprising:

a latch plate (20) comprising:

a first part or tongue (26) for lockingly engaging a cooperating part of a seat belt buckle (100);

a rear or second part (26) including a seat belt clamping surface (30) adjacent a seat belt receiving opening (28) within the second part;

a yoke (40) slidably received upon the latch plate (20) and movable relative to the belt receiving opening, including a clamping bar (48), wherein a portion of the seat belt (90) lays through the belt receiving opening (28) between the belt clamping surface and the clamping bar;

a clamp initiating mechanism (60) manually movable from a first position in which the seat belt is free to slide through the opening to a locking position in which the seat belt is locked, including a cam surface (63) which when moved to the locking position urges the clamping bar toward the clamping surface to thereby clamp the seat belt therebetween and first means cooperable with a seat belt buckle to maintain the mechanism (60) in its locking position.

* * * * *